US008011190B2

(12) United States Patent
Simmons

(10) Patent No.: US 8,011,190 B2
(45) Date of Patent: Sep. 6, 2011

(54) PRODUCT COOLING

(75) Inventor: Philip Andrew Simmons, Alcester (GB)

(73) Assignee: IMI Cornelius Inc., Glendale Heights, IL (US)

( * ) Notice: Subject to any disclaimer, the term of this patent is extended or adjusted under 35 U.S.C. 154(b) by 190 days.

(21) Appl. No.: 12/224,198

(22) PCT Filed: Feb. 21, 2007

(86) PCT No.: PCT/GB2007/000598

§ 371 (c)(1),
(2), (4) Date: Mar. 30, 2009

(87) PCT Pub. No.: WO2007/096609

PCT Pub. Date: Aug. 30, 2007

(65) Prior Publication Data

US 2009/0314011 A1 Dec. 24, 2009

(30) Foreign Application Priority Data

Feb. 21, 2006 (GB) ..... 0603365.8

(51) Int. Cl.
*F25D 3/00* (2006.01)

(52) U.S. Cl. ..... 62/59; 62/389

(58) Field of Classification Search ..... 62/59, 330, 62/389–400, 434–435
See application file for complete search history.

(56) References Cited

U.S. PATENT DOCUMENTS

| | | | | |
|---|---|---|---|---|
| 4,538,428 | A * | 9/1985 | Wilkerson | 62/354 |
| 5,005,364 | A * | 4/1991 | Nelson | 62/76 |
| 5,381,670 | A * | 1/1995 | Tippmann et al. | 62/330 |
| 5,743,108 | A * | 4/1998 | Cleland | 62/393 |
| 6,367,268 | B1 | 4/2002 | Paul | |
| 6,405,555 | B1 * | 6/2002 | Rowland et al. | 62/390 |
| 6,609,391 | B2 * | 8/2003 | Davis | 62/393 |
| 7,389,647 | B1 * | 6/2008 | Abraham, III | 62/98 |

FOREIGN PATENT DOCUMENTS

| | | |
|---|---|---|
| EP | 1 148 023 A1 | 10/2001 |
| GB | 2 172 876 A | 10/1986 |
| GB | 2 417 061 A | 2/2006 |
| WO | WO 97/28082 | 8/1997 |

* cited by examiner

*Primary Examiner* — Melvin Jones
(74) *Attorney, Agent, or Firm* — Pyle & Piontek, LLC

(57) ABSTRACT

A cooling system for beverage dispense has a circuit 5 in which binary ice is circulated. A modular heat exchange unit 13 for a plurality of beverage lines 25,27,29,31,33 is connected to the circuit 5 for cooling beverage prior to dispense from a dispense tap 35 in a serving area such as a bar. The ice fraction in the binary ice provides a thermal store that can absorb heat without increasing the temperature of the binary ice and enables the system to respond quickly to changes in the cooling requirements in the circuit 5.

17 Claims, 6 Drawing Sheets

PRODUCT COOLING

BACKGROUND OF THE INVENTION

This invention relates to product cooling, and in particular to the application of binary ice as a coolant for consumable products such as food and beverages and/or equipment associated with the storage and/or preparation and/or supply of such products. The term binary ice is used herein to mean a flowable mixture of frozen and unfrozen material.

FIELD OF THE INVENTION

The invention is described with particular, but not exclusive, application to beverages and it will be understood that we do not intend the invention to be limited to beverages.

Beverages for consumption by a customer in a serving area such as a bar may be provided in small containers such as cans or bottles containing a volume of beverage corresponding to a single portion or serving. Alternatively, beverages may be provided in large containers such as kegs or barrels containing a volume of beverage corresponding to many portions or servings.

The beverage may be chilled for serving at an optimum temperature for taste and appearance. For example cans or bottles may be stored in a refrigerated cabinet in the bar area while kegs or barrels are typically stored remote from the bar area with a dispense system employed to deliver the beverage to a dispense head in the bar area for dispense at the required temperature.

The known dispense systems typically employ one or more coolers to cool the beverage to the required dispense temperature. The beverage source is usually positioned in a cold room remote from the bar area and a product line from the beverage source passes through a cooler located in or close to the cold room before passing to the dispense head. The bar area may be located a considerable distance from the cold room requiring a long product line to reach the dispense head.

It is common practice therefore to arrange the product line in an insulated sheath often referred to as a python and to circulate coolant from the cooler through the sheath in a coolant re-circulation loop to prevent the beverage warming up in the product line between the cold room and the dispense head. The sheath may contain several product lines for connection to dispense heads in the same or different bar areas. The coolant in the re-circulation loop may also pass with the product line to the dispense head to cool the dispense head.

In use, the beverage in the product line(s) is cooled by heat transfer to the coolant in the re-circulation loop thereby warming up the coolant. In systems where the product line(s) is of long length and/or where condensing fonts are employed, there can be a significant temperature difference between the coolant leaving and returning to the cooler in the cold room. As a result, the efficacy of the coolant in cooling the beverage is reduced as it warms up and this can lead to the product being dispensed at a temperature higher than the optimum temperature.

This can have an adverse affect on the dispense of the product, for example higher dispense temperatures lead to increased break-out of carbon dioxide from carbonated products causing foaming of the product leading to increased pour times and wastage. Also the taste and appearance of the product may be altered sufficiently to be discernible to the customer. This can be a particular problem for dispense of carbonated beverages such as beer, lager, cider.

Prior proposals to address this problem have involved the use of so called "ice bank" coolers which employ chilled water as the coolant. In these coolers, a solid mass of ice (the "ice bank") is formed in the cooler during periods of low demand which melts to meet the increased cooling requirement during periods of high demand. In this way, the ice bank provides a thermal reserve to smooth-out variations in the cooling requirement.

A disadvantage of ice bank coolers is that they can usually only provide product cooling down to about 4° C. Recently there is an increased trend towards dispense of products at temperatures approaching or below 0° C. which has lead to the use of coolers which employ a water/glycol mixture as the coolant (so called "glycol" coolers).

While these glycol coolers allow cooling approaching or below 0° C., they do not provide a thermal reserve like ice bank coolers. As a result, there can be a delay in response to increased cooling requirements, for example during periods of high demand. Furthermore, there may be a delay in getting to operating temperature on start-up of the refrigeration system.

It is already known to provide additional cooling in the bar area adjacent to the dispense head to provide colder product dispense temperatures and to reduce the effects of temperature change of the coolant in the coolant loop so that the beverage is dispensed at the correct temperature. Such additional cooling is typically provided by individual heat exchangers or coolers located on a shelf below the dispense head. The provision of such additional cooling adds to both installation costs and running costs.

Moreover, additional coolers generate a significant heat output in the bar area resulting in higher temperatures in the bar area that may be uncomfortable for staff and customers and that increases the cooling load on air conditioning and other equipment in the bar area such as refrigerated cabinets for bottles and cans thereby increasing the running costs of such equipment

SUMMARY OF THE INVENTION

The present invention has been made from a consideration of the foregoing.

According to a first aspect, the present invention provides a method of cooling a consumable product such as a beverage in which binary ice is used as a coolant.

By employing binary ice comprising a flowable mixture of frozen and unfrozen material as the coolant, the frozen material, for example ice crystals, provides a thermal store of energy whereby heat transferred to the binary ice from the product is absorbed by causing the frozen material to melt leading to little or no change in temperature of the binary ice as the fraction of frozen material in the mixture reduces.

In this way, where the binary ice is used in a beverage dispense system employing a coolant re-circulation loop, the efficacy of the binary ice to maintain the desired temperature of the beverage is maintained even where the product line(s) is of long length and/or supplies beverage to several dispense heads in the same or different serving areas.

In particular, the thermal store of energy is provided by the presence of the binary ice in the re-circulation loop enabling the system to respond more effectively to changes in the cooling requirement than the known ice bank and glycol coolers where the response occurs in the cooler and the coolant is then circulated through the re-circulation loop.

Consequently, the required cooling may be achieved with lower flow rates of binary ice compared to the known ice bank and glycol coolers allowing a smaller capacity pump to be used providing further cost and energy savings.

Moreover, the use of binary ice as the coolant in the coolant re-circulation loop to absorb heat with little or no significant change in temperature has other potential benefits. For example, the loop can be used to provide cooling for other equipment in the serving area such as refrigerated cabinets, cold shelves, chilled sinks, frozen or condensing dispense fonts, chilled or frozen displays, bottle coolers, wine coolers, ice makers, air conditioning. Alternatively or additionally, the loop may be employed to provide cooling in other areas such as food preparation areas in a kitchen or the like and/or in storage areas for food or beverages. Other applications will be apparent to those skilled in the art.

According to a second aspect, the present invention provides a beverage dispense system comprising a beverage source, a dispense head, a product line for supplying beverage from the beverage source to the dispense head and a coolant line containing coolant in heat exchange relationship with product in the product line wherein the coolant comprises binary ice.

The binary ice absorbs heat from the product by melting the frozen material in the binary ice whereby a desired product temperature is maintained without significant change in temperature of the binary ice.

Preferably, the coolant line is connected to a source of binary ice, for example a reservoir in which binary ice is produced and/or stored.

In one preferred arrangement, the coolant line comprises a recirculation loop for returning binary ice to the reservoir or to a binary ice generator supplying binary ice to the reservoir.

According to a third aspect, the present invention provides a cooling circuit containing binary ice for cooling a plurality of modules connected to the circuit, wherein at least one of the modules is a beverage dispense unit.

The binary ice may cool beverage dispensed from said at least one beverage dispense unit. Alternatively or additionally, the binary ice may cool part of the dispense unit, for example to create condensation or ice on an external surface of the dispense unit such as a font that is visible to the customer.

Modules may be connected to the circuit to provide a variety of functions. For example modules may be employed in a serving area such as a bar and/or in a preparation area such as a kitchen. Modules may include refrigerated cabinets, cold shelves, cold stores, overhead chillers, chilled sinks, chilled or frozen displays, bottle coolers, wine coolers, ice makers, air conditioning and other uses as will be apparent to those skilled in the art.

According to a fourth aspect, the present invention provides a cooling system employing binary ice for cooling in a serving area and/or a preparation area and/or a storage area for consumable products.

The consumable products may be food and/or beverage. The binary ice may cool the food and/or beverage. Alternatively or additionally, the binary ice may cool equipment used for serving and/or preparing and/or storing such products. Alternatively or additionally, the binary ice may cool the area, for example to maintain a comfortable environment.

According to a fifth aspect, the present invention provides a heat exchanger comprising a first flow passage extending between an inlet and an outlet for a first fluid, the first flow passage being located between a pair of plates defining therewith a second flow passage extending between an inlet and an outlet for a second fluid.

The first and second flow passages allow heat exchange between two fluids flowing through the passages, for example a product such as a beverage and a coolant. The coolant may be a liquid or binary ice.

The heat exchanger may be surrounded with insulation to prevent heat ingress from the surroundings and/or formation of condensation on the heat exchanger.

The heat exchanger may have opposed substantially planar (flat) faces and, a plurality of heat exchangers may be assembled in face-to-face relationship to form a modular heat transfer unit. The heat transfer unit may be surrounded with insulation to prevent heat ingress from the surroundings and/or formation of condensation on the heat exchangers.

The flow passages preferably follow convoluted paths to maintain high flow velocity and increase the heat transfer rate between the fluids. For example, the flow passages may be of serpentine shape. The high flow velocity also helps to prevent separation of the binary ice due to buoyancy effects.

The first flow passage may comprise a tubular duct located within the second flow passage. In this way, the first flow passages may be surrounded by the second fluid within the second flow passage.

BRIEF DESCRIPTION OF THE DRAWINGS

The invention will now be described in more detail by way of example only with reference to the accompanying drawings wherein.

DETAILED DESCRIPTION

Figure 1:
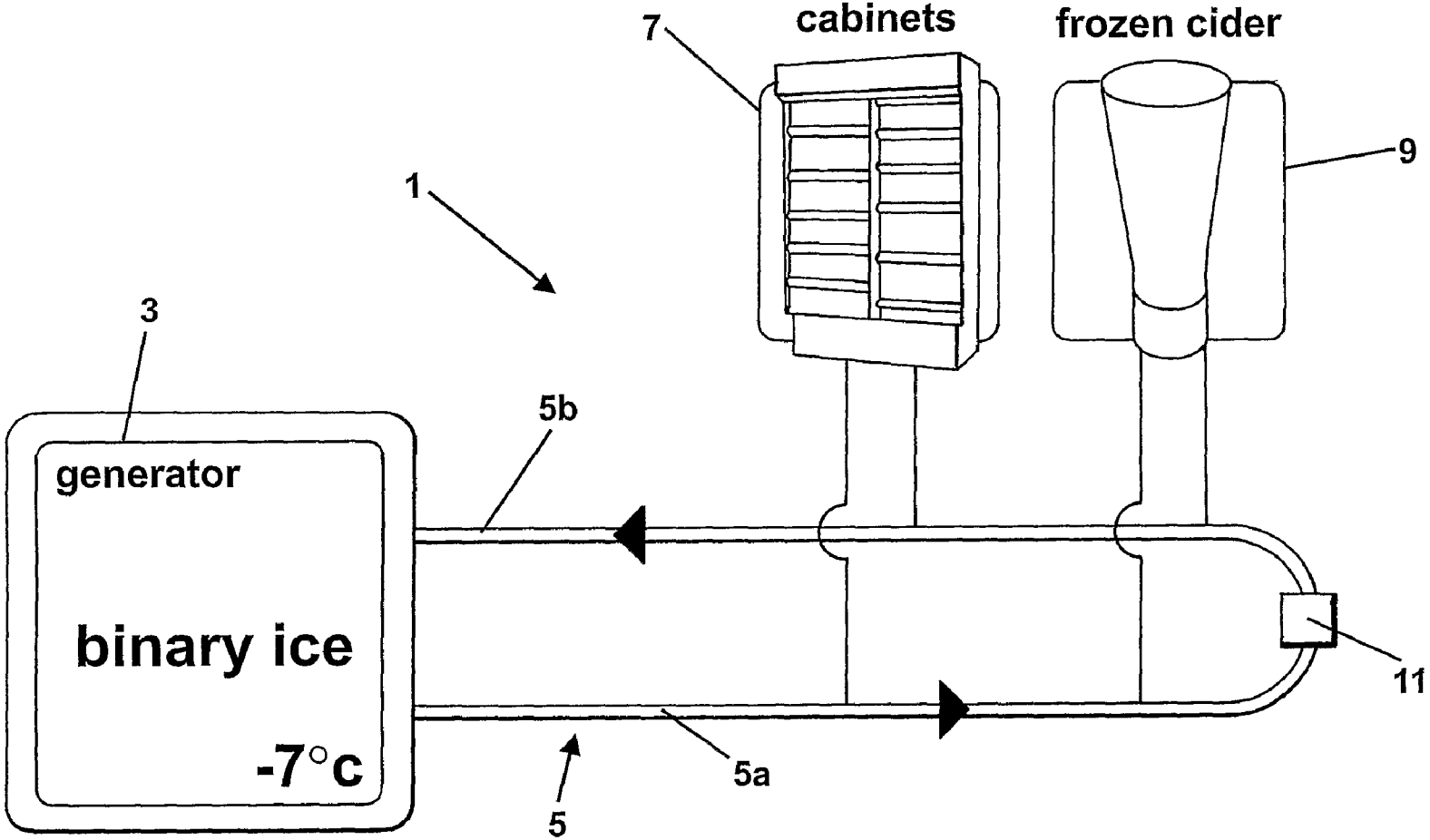
FIG. 1 shows a first embodiment of a cooling circuit according to the present invention.

Referring first to FIG. 1 of the drawings, there is shown a cooling circuit 1 employing flowable binary ice as the coolant. The binary ice is produced in a suitable generator 3 that may include a reservoir for storing the binary ice and is circulated in a closed loop 5 by means of a pump (not shown) such as a positive displacement pump or other suitable pump. The binary ice generator 3 is not described as the details of suitable generators will be familiar to those skilled in the art.

The binary ice comprises a mixture of frozen and unfrozen material and, in this embodiment, is produced from a water/glycol mixture to contain an ice fraction of approximately 25% to 35% at a temperature of about minus 7° C. although it will be appreciated this is by way of example only and is not limiting on the scope of the invention.

It will be understood that binary ice employed in this invention may be produced from any suitable starting material but is typically obtained from water with or without an added antifreeze agent such as glycol to produce binary ice having a desired temperature for the intended application. It will also be understood that the ice fraction in the binary ice may be varied according to the cooling requirements of a particular application while maintaining a flowable mixture of frozen and unfrozen material that can be circulated around the loop 5.

The cooling circuit 1 may be employed to supply coolant to modules in an area where a cooling load is required such as a serving area, for example in a bar, or a food preparation area, for example in a kitchen, or a storage area for example a cellar or cold room. In this embodiment, the loop 5 is shown connected to a refrigerated cabinet 7 for storing bottles or cans of beverages and to a unit 9 for dispensing frozen cider. Each module 7, 9 has an inlet connected to a supply section 5*a* of the loop and an outlet connected to a return section 5*b* of the loop and, the loop 5 is provided with a pressure differential valve 11 between the supply section 5*a* and the return section 5*b* to ensure flow of the binary ice coolant to each module 7, 9 when required.

It will be understood that the number and purpose of the modules connected to the loop 5 may be altered as desired. It will also be understood that the binary ice generator 3 may supply binary ice to more than one cooling circuit for circulating binary ice coolant to modules in different locations for any purpose, for example modules located in separate serving areas and/or food preparation areas and/or storage areas.

In use, binary ice is circulated around the loop 5 to separate heat exchangers (not shown) associated with the modules 7, 9 where heat is transferred from the modules 7, 9 to the binary ice to provide a cooling load according to the function of the module 7, 9. The ice fraction in the binary ice gradually melts as heat is transferred to the binary ice enabling the heat to be absorbed with little or no significant increase in temperature of the binary ice circulating in the loop 5 until the ice fraction has completely melted. In this way, the cooling efficacy of the binary ice supplied to each module 7, 9 connected to the loop 5 is maintained while a portion of ice fraction remains to be melted.

It will be understood that the ice fraction in the binary ice produced by the generator 3 for circulation in the loop 5 can be varied according to the total cooling requirements of all the modules connected to the loop 5 so that the ice fraction does not completely melt before the binary ice is returned to the generator. We have found that an ice fraction of approximately 25% to 35% provides sufficient cooling for most applications but it will be understood we do not intend to be limited to this and that ice fractions higher or lower than this may be employed as appropriate.

Figure 2:
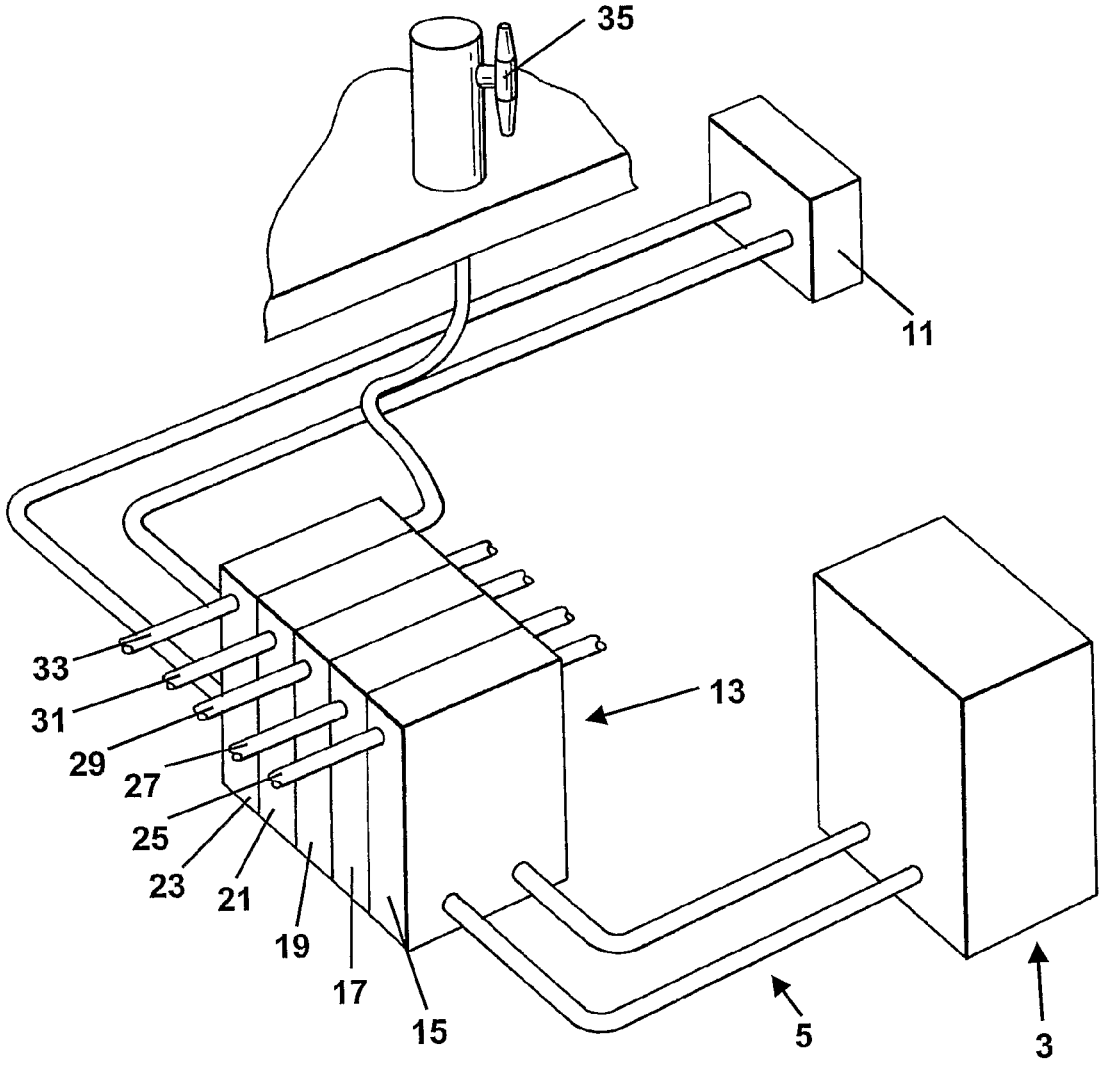
FIG. 2 shows a second embodiment of a cooling circuit according to the present invention.

Referring now to FIG. 2 of the drawings, there is shown a modification to the cooling circuit of FIG. 1. For convenience, like reference numerals are used to indicate corresponding parts.

In this embodiment, the re-circulation loop 5 is shown connected to a modular heat exchange unit 13 remote from the binary ice generator/binary ice reservoir 3. The unit 13 comprises a plurality of heat exchangers 15, 17, 19, 21, 23 of flat rectangular shape arranged in face-to-face contact to provide a compact unit. It will be understood that any number of heat exchangers may be combined to form the modular heat exchange unit according to the layout of a given installation. It will also be understood that more than one modular heat exchange unit may be connected to the re-circulation loop according to the lay-out of a given installation.

Each heat exchanger in the unit is connected to a respective product line 25, 27, 29, 31, 33 for supplying product to a respective dispense tap 35 (one only shown). For example the product lines may be connected to remote sources of alcoholic beverages such as beer, lager, cider or the like, or non-alcoholic beverages such as colas, fruit juices or other soft drinks. Beverages may be carbonated or uncarbonated. The unit 13 may be located under the bar or in any other convenient location close to the dispense point(s) and is covered with suitable insulation material (not shown) to reduce heat ingress from the surrounding environment and/or formation of condensation on the unit 7.

The binary ice generator/binary ice reservoir 3 may be connected to a manifold (not shown) with valves operable to control flow of binary ice through individual heat exchangers in response to flow of product through the heat exchanger to cool the product to the required temperature for dispense. Alternatively or additionally, the heat exchangers may be configured to control the flow of coolant in response to flow of product there through.

Figure 3:
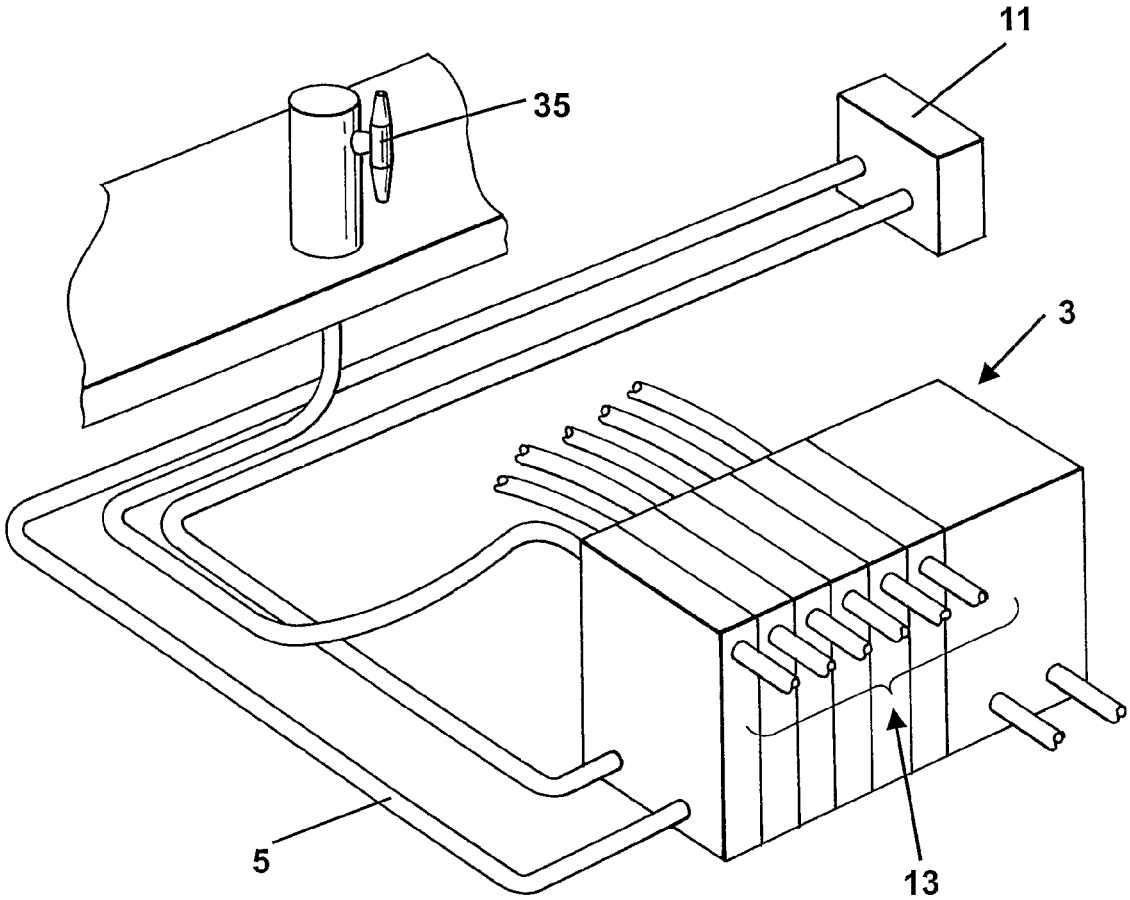
FIG. 3 shows a third embodiment of a cooling circuit according to the present invention.

Referring now to FIG. 3 of the drawings, there is shown a modification to the cooling circuit of FIG. 2 in which the binary ice generator/binary ice reservoir 3 is combined with the heat exchange unit 13. For convenience, like reference numerals are used to indicate corresponding parts and the operation of this system will be understood from the description of previous embodiments.

Figure 4:
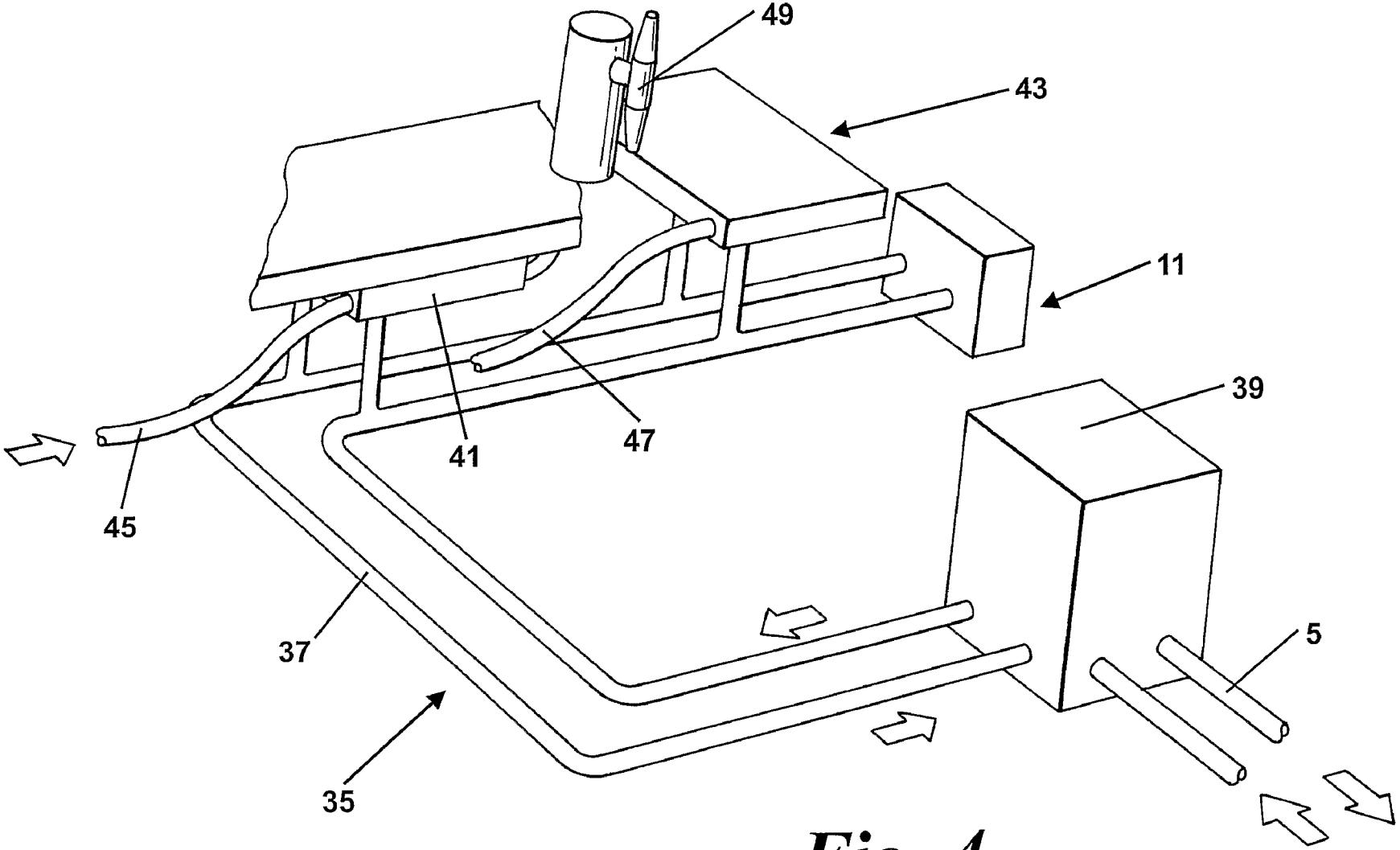
FIG. 4 shows a fourth embodiment of a cooling circuit according to the present invention.

Referring now to FIG. 4 of the drawings, there is shown a modification to the cooling circuit of FIG. 1. For convenience, like reference numerals are used to indicate corresponding parts.

In this embodiment, the binary ice cooling circuit 1 above-described is employed to provide cooling for a second cooling circuit 35. This second circuit 35 employs a water/glycol mixture in a re-circulation loop 37 as the coolant. The composition of the water/glycol mixture in the second circuit 35 is the same as that used to produce the binary ice in the first circuit 1 but, is cooled to a temperature of approximately −3° C. at which it remains a liquid with no frozen ice particles.

The cooling circuit 35 may be employed to supply coolant to modules in a serving area or food preparation area where the cooling load required is lower than that provided by the binary ice circuit 1. For example, in this embodiment, the re-circulation loop 37 is shown connected to under counter heat exchangers 41 and 43 for product lines 45, 47 respectively connected to dispense taps 49 (one only shown).

The product lines 45, 47 may be connected to sources of alcoholic beverages such as beer, lager, cider or the like or non-alcoholic beverages such as cola, carbonated water, fruit juice or other soft drinks. It will be understood that the number and purpose of the modules connected to the re-circulation loop 37 may be altered as desired. It will also be understood that the heat exchangers for the modules may be arranged separately as shown or combined in a heat exchange unit as shown in FIGS. 2 and 3.

In use, the water/glycol coolant is circulated around the re-circulation loop 37 to the heat exchangers 41, 43 where heat is transferred from the product to the coolant to cool the product to the desired temperature for dispense. Flow through the heat exchangers 41, 43 may be controlled by valves in response to flow of product and/or actuation of a dispense or any other suitable control methodology.

Unlike the binary ice coolant in the loop 5, the water/glycol coolant in the re-circulation loop 37 does not have a thermal reserve capable of absorbing heat transferred to it and is therefore gradually warmed up by heat transfer from the product in the heat exchangers 41, 43 connected to the loop 37 leading to a cooling requirement in the circuit 35.

In this embodiment, the cooling requirement in the circuit 35 is met by means 39 connecting the binary ice loop 5 of the first circuit 1 to the re-circulation loop 37 and controlling the addition of binary ice to the loop re-circulation 37 and return flow of liquid coolant from the re-circulation loop 37 to the binary ice loop 5 according to the cooling requirement. This is possible because both circuits 1, 35 employ the same water/glycol mixture as the coolant.

Figure 5:
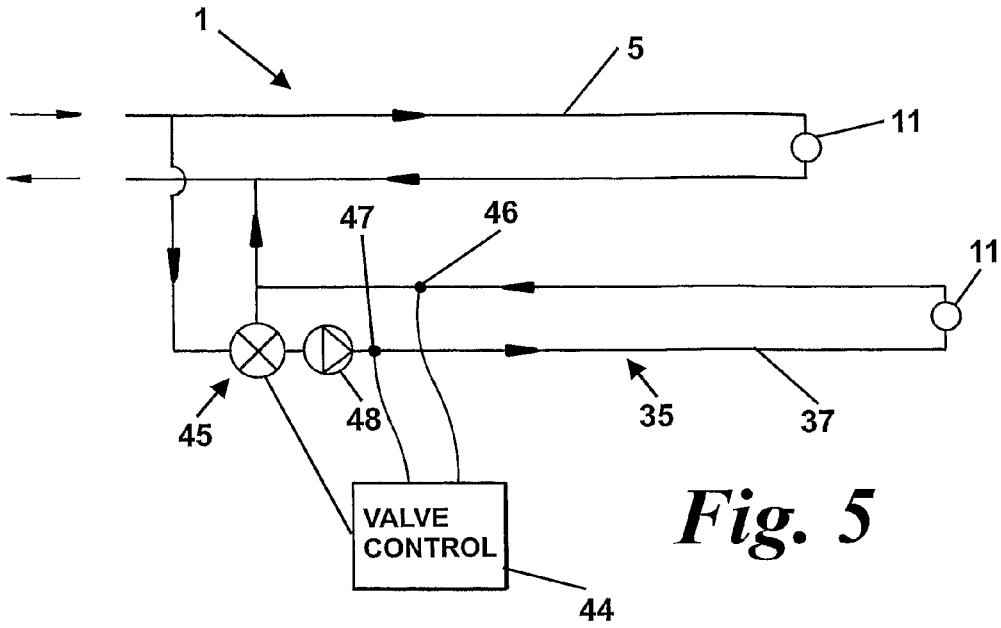
FIG. 5 shows diagrammatically one lay-out of the cooling circuit shown in FIG. 4.

Referring now to FIG. 5, one arrangement of means 39 for controlling the addition of binary ice from the circuit 1 to the circuit 35 is shown employing a controller 44 for operating a three-way valve 45 in response to the temperature of the coolant detected by temperature sensors 46,47 in supply and return sections 37*a*, 37*b* of the re-circulation loop 37. The three-way valve 45 may provide on/off and/or variable control of the addition of binary ice to the circuit 35. A pump 48 for circulating the coolant in the loop 37 is also shown.

Figure 6:
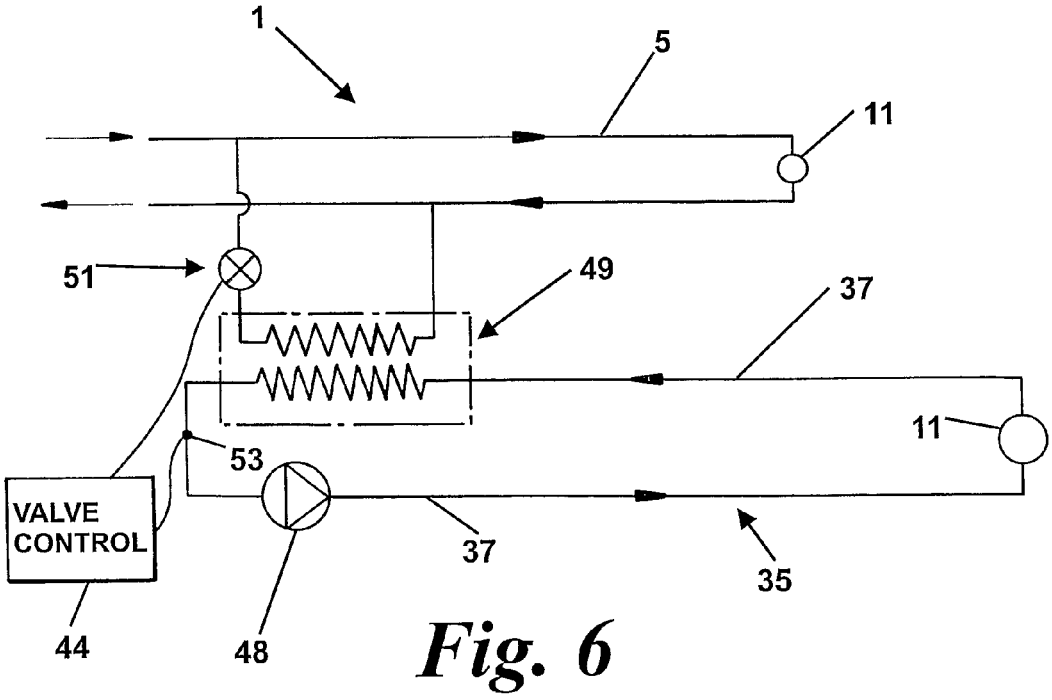
FIG. 6 shows diagrammatically an alternative lay-out of the cooling circuit shown in FIG. 4.

Referring now to FIG. 6, a modification to the arrangement of FIGS. 4 and 5 is shown in which like reference numerals are used to indicate corresponding parts. In this modification, the circuits 1, 35 are connected to a heat exchanger 49 and the controller 44 operates a two-way valve 51 to control circulation of binary ice through the heat exchanger 49 in response to the temperature of the coolant in the re-circulation loop 37 detected by a temperature sensor 53. The two-way valve 51 may provide on/off and/or variable control of the flow of binary ice through the heat exchanger 49.

In a further modification (not shown), the binary ice circuit 1 in FIG. 6 may be employed to remove heat from a conventional refrigeration system. In this way, it may be possible to reduce the size of the cooling equipment for the same temperature drop or to increase the temperature drop for the same size cooling equipment. For example, the construction of a freezer that operates at minus 30° C. allowing chilling and freezing food at a faster rate. As a result, bacterial growth in the food may be reduced. Alternatively, reducing the cooling size required and thereby releasing space for the storage of goods at the required temperature. As a result, utilisation of space may be increased.

With the arrangements shown in FIGS. 4 to 6, the temperature of the coolant in the water/glycol circuit 35 can be controlled using the binary ice circuit 1. As a result, the provision of separate cooling for the water/glycol circuit 35 can be avoided and the water/glycol circuit 35 can be considered to constitute a module connected to the binary ice circuit 1.

The arrangement shown in FIGS. 4 and 5 may be used where the circuits 1, 35 have the same coolant materials and the arrangement shown in FIG. 6 may be employed where the circuits 1, 35 have the same or different coolant materials.

It will be understood that the invention is not limited to the cooling circuits above-described and that modifications and changes can be made to the configuration and/or materials employed. For example, the cooling circuits may comprise any suitable composition of flowable binary ice providing a source of coolant having the required temperature(s) for the intended application. The binary ice generator may supply flowable binary ice to a plurality of circuits according to the cooling requirements in each circuit.

Figure 7:
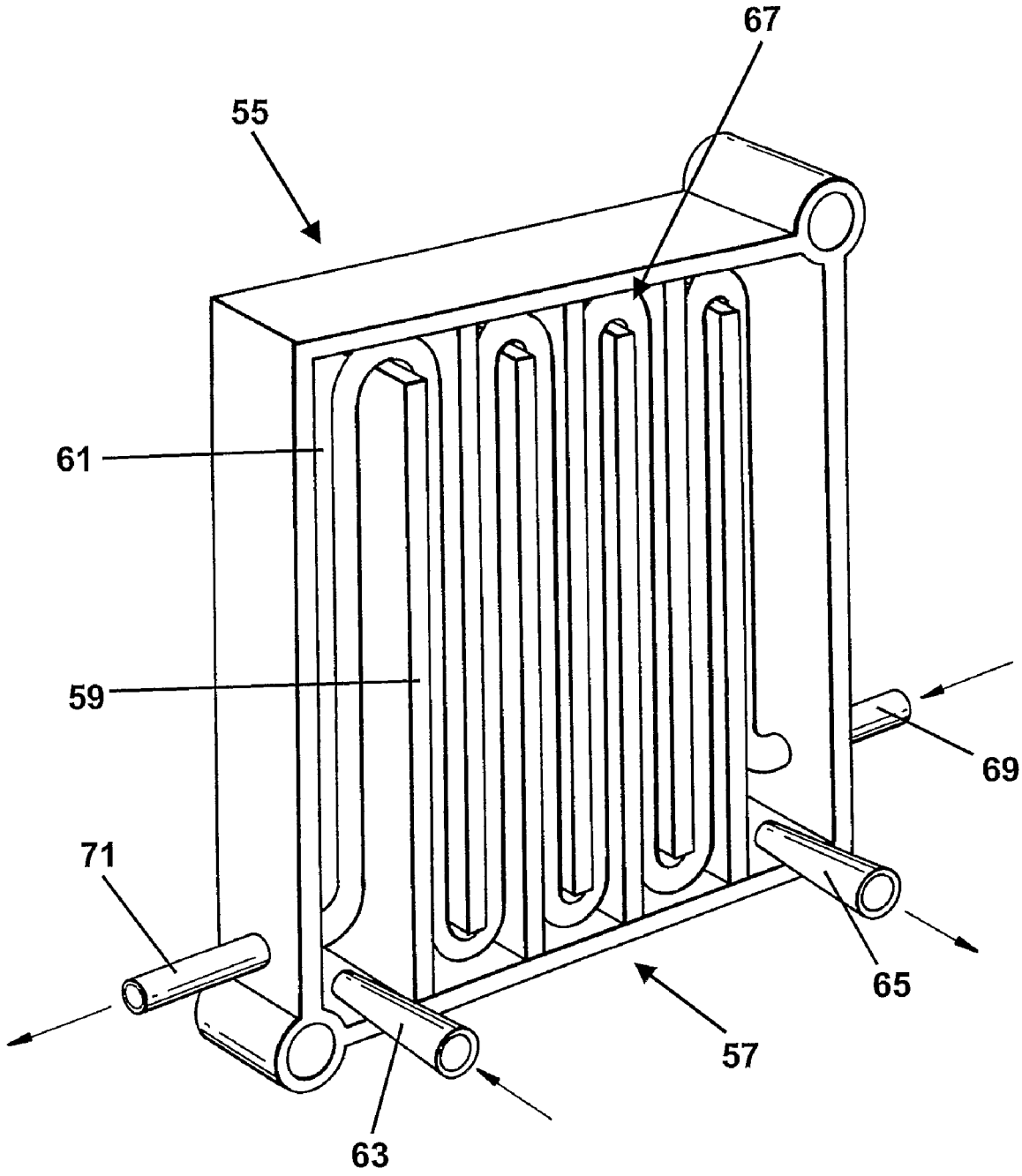
FIG. 7 shows a heat exchanger according to the present invention.

Referring now to FIG. 7 of the drawings, there is shown a heat exchanger 55 for use in the cooling circuits 1, 35 above-described.

The heat exchanger 55 comprises an outer shell 57 of rectangular shape with internal baffles 59 that form a serpentine flow path 61 from an inlet 63 to an outlet 65 for passing coolant through the heat exchanger 55. The flow path is configured to maintain high flow velocity of the coolant. This is beneficial when binary ice is employed as the coolant to prevent or reduce the ice separating due to buoyancy effects.

The shell 57 houses a tubular duct 67 that is configured to follow the serpentine flow path 61 from an inlet 69 to an outlet 71 for passing a product through the heat exchanger 55. The duct 67 is surrounded by coolant within the flow path 61 providing a large surface area for heat exchange between the coolant and the product.

As will be appreciated, the heat exchanger 55 is of simple, compact construction that can be assembled from inexpensive components. Furthermore, the configuration of the outer shell 57 with flat, planar faces allows a plurality of the heat exchangers 55 to be assembled in face-to-face array to form a modular heat transfer unit as described above that can be accommodated in the bar area.

It will be understood that the invention is not limited to the heat exchanger 55 above-described and that modifications and changes can be made to the construction of the heat exchanger. For example, the outer shell may be of any suitable construction to provide a flow path for the coolant. The flow path within the outer shell for the product may be provided by a tubular duct as described or by any other suitable means forming a product flow path separate from the coolant flow path.

Furthermore, it will be appreciated that individual features of any of the embodiments describe herein may be employed separately or in combination with features of any of the other embodiments and all variations are within the scope of the invention.

The invention claimed is:

1. A method of cooling beverages, comprising the steps of:

generating binary ice; and heat transfer coupling the binary ice to the beverage to cool the beverage, wherein said generating step comprises generating binary ice at a first location, and including the step of flowing binary ice from the first location to a second location, said heat transfer coupling step comprising heat transfer coupling binary ice at the second location to beverage to be cooled, wherein said flowing step comprises flowing the binary ice through a closed loop coolant recirculation circuit extending between the first and second locations.

2. A method according to claim 1, including the step of dispensing the beverage with a beverage dispense system, said flowing step comprising flowing the binary ice from the first location to the second location through the closed loop coolant recirculation circuit, and said heat transfer coupling step comprising heat transfer coupling the coolant recirculation circuit to beverage at the second location.

3. A method according to claim 2, including the further steps of flowing binary ice through the coolant recirculation circuit to a third location; and heat transfer coupling the coolant circuit at the third location to equipment for food.

4. A method according to claim 3, wherein the equipment for food is one or more of a refrigerated cabinet, a cold room, a cold shelve, a chilled sink, a frozen or condensing dispense font, a chilled or frozen display, a bottle cooler, a wine cooler, an ice maker and an air conditioning unit.

5. A method according to claim 2, wherein said heat transfer coupling step is performed by flowing each of the binary ice and the beverage through a heat exchanger to cool the beverage within the heat exchanger by heat exchange with the binary ice.

6. A method according to claim 2, including the further step of controllably heat transfer coupling the binary ice coolant recirculation circuit to a second coolant circuit to control the temperature of coolant in the second coolant circuit.

7. A method according to claim 6, wherein said step of controllable heat transfer coupling is performed by controllably adding binary ice from the binary ice coolant recirculation circuit to the coolant in the second coolant circuit to control the temperature of the coolant in the second coolant circuit.

8. A method according to claim 6, wherein said step of controllable heat transfer coupling is performed by controllably heat exchange coupling binary ice in the binary ice coolant recirculation circuit to the coolant in the second coolant circuit.

9. A method according to claim 2, wherein said flowing step comprises flowing binary ice through the coolant circuit at a flow velocity equal to or greater than a selected minimum flow velocity to prevent separation of ice from liquid.

10. A method according to claim 9, wherein the binary ice comprises a water/glycol mixture.

11. A beverage dispense system, comprising:

a beverage dispenser having a beverage dispense head;

means for flowing beverage from a beverage supply to said dispense head for dispensing of the beverage by said dispense head;

means for generating binary ice; and means for heat transfer coupling generated binary ice to beverage to be dispensed by said dispense head to cool the beverage, wherein said means for generating binary ice generates binary ice at a first location, and including means for flowing binary ice from said first location to a second location, said means for heat transfer coupling comprising means at said second location for heat transfer coupling binary ice to beverage to be dispensed by said dispense head, wherein said means for flowing binary ice includes means for flowing binary ice through a coolant circuit extending from said first to said second location, and said means for heat transfer coupling comprises a heat exchanger through which binary ice and beverage from the beverage supply are flowed to cool the beverage by heat exchange with the binary ice in the coolant circuit, wherein said coolant circuit is a closed-loop binary ice coolant recirculation circuit.

12. A beverage dispense system according to claim 11, including a second closed-loop coolant recirculation circuit, and means for heat transfer coupling said binary ice coolant recirculation circuit to said second coolant recirculation circuit to control the temperature of coolant in said second circuit.

13. A beverage dispense system according to claim 12, wherein said means for heat transfer coupling said binary ice coolant recirculation circuit to said second coolant recirculation circuit includes means for adding binary ice from the binary ice coolant recirculation circuit to coolant in the second coolant recirculation circuit.

14. A beverage dispense system according to claim 11, wherein said means for heat transfer coupling at said second location includes means for heat transfer coupling binary ice to said dispense head.

15. A beverage dispense system according to claim 11, wherein said beverage dispenser has a plurality of dispense heads, and including a plurality of heat exchangers each for an associated one of said dispense heads for cooling beverage flowed to the associated dispense head.

16. A beverage dispense system according to claim 15, wherein each said heat exchanger is located close to its associated dispense head.

17. A beverage dispense system according to claim 15, wherein said plurality of heat exchangers are combined in a single heat exchange unit.

* * * * *